US006503140B1

(12) United States Patent
Haynes

(10) Patent No.: US 6,503,140 B1
(45) Date of Patent: Jan. 7, 2003

(54) AIR REGISTER

(75) Inventor: Gerald D. Haynes, Elkhart, IN (US)

(73) Assignee: Continental Industries, Inc., Elkhart, IN (US)

( * ) Notice: Subject to any disclaimer, the term of this patent is extended or adjusted under 35 U.S.C. 154(b) by 0 days.

(21) Appl. No.: 10/008,805

(22) Filed: Nov. 13, 2001

(51) Int. Cl.[7] ..... F24F 13/15
(52) U.S. Cl. ..... 454/290; 454/325
(58) Field of Search ..... 454/290, 325, 454/335

(56) References Cited

U.S. PATENT DOCUMENTS

| | | | | |
|---|---|---|---|---|
| 3,938,430 | A | 2/1976 | Koppang | |
| 4,014,253 | A | 3/1977 | Dry | |
| 4,417,687 | A | 11/1983 | Grant | |
| 4,876,951 | A | 10/1989 | Vork | |
| 4,907,500 | A | 3/1990 | Brown | |
| D309,347 | S | 7/1990 | Brown | |
| 5,312,298 | A | 5/1994 | Myers | |
| 5,588,911 | A | 12/1996 | Gomez | |
| 5,792,230 | A | 8/1998 | Moore et al. | |
| D413,665 | S | 9/1999 | Hudson | |
| 5,971,847 | A | 10/1999 | Webb | |
| 5,984,776 | A | 11/1999 | Berger | |
| 6,033,304 | A * | 3/2000 | Haynes | 454/290 |
| 6,322,442 | B1 * | 11/2001 | Cordell | 454/290 |
| 2002/0022450 | A1 * | 7/2001 | Berger | 454/290 |

FOREIGN PATENT DOCUMENTS

WO 94/15155 * 7/1994

OTHER PUBLICATIONS

Set of photographs, 5 black and white pictures.
Set of photgraphs, 11 color pictures.

* cited by examiner

*Primary Examiner*—Harold Joyce
(74) *Attorney, Agent, or Firm*—Baker & Daniels

(57) ABSTRACT

A register to be mounted in a vent opening of a wall, floor, or ceiling for regulating the passage of air. The register includes a grill having a plate with grill openings for directing the passage of air therethrough, a frame connected to the bottom of the grill, at least one damper for regulating air flow through the register, a pivotal connection connecting the damper to the frame to allow pivotal movement therebetween, and a control mechanism for moving the damper between an open position permitting air to flow through the register and a closed position wherein air is inhibited from flowing through the register. The damper has first and second connecting ears extending from a major plane of the damper in directions opposite from one another. The control mechanism is pivotally connected to at least one of the connecting ears and includes a control bar having a spring member biasing the damper towards the frame. In one embodiment, the register has two dampers which rotate in opposite directions from one another. The control mechanism moves the dampers in a push-pull manner, wherein as the dampers are pivoted, the control mechanism pushes on one of the dampers while simultaneously pulling on the other damper.

34 Claims, 10 Drawing Sheets

AIR REGISTER

BACKGROUND

The present invention relates to a register for controlling air flow into a room from an air duct in a floor, wall or ceiling and, in particular, to a register which has at least one damper and a unique control mechanism and linkage for moving the damper between an open and a closed position.

It has become well known to use air registers to control the flow of heated, cooled or vented air from a duct system into a room. The register is commonly mounted within a duct opening of the duct system and typically includes fixed or adjustable grill openings or louvers on a grill or face plate of the register. Mounted to the grill is a register frame or body which extends into the duct helping to secure the register thereto and directing airflow through to the face plate. Registers typically employ one or more adjustable dampers within the register body to control the direction and volume of air flow. The dampers can typically be moved between a closed position blocking airflow through the register, a partially opened position, and a fully opened position maximizing airflow therethrough.

An example of a prior art register and control mechanism is found in U.S. Pat. No. 3,938,430 to Koppang, incorporated herein by reference. In the register disclosed in Koppang, a pair of vanes or dampers are moved by pivoting a lever having a spur gear attached thereto, which in turn rotates a mating spur gear. One spur gear is mounted on each damper so that the dampers pivot between the open and closed positions as the spur gears are rotated. Another air register vent is disclosed in U.S. Pat. No. 5,312,298 to Myers, incorporated herein by reference. The dampers in Myers are also operated by spur gears. One spur gear is used as a thumb wheel for controlling the unit. The thumb wheel is connected to a pair of mating spur gears that are each mounted on a damper. The dampers rotate with the spur gears.

Another prior art register, generally indicated as 10, is shown in FIGS. 1 and 2. Prior art register 10 includes a grill 12, a frame 14, a pair of dampers 16*a*, 16*b*, an operating lever 18, and a following lever 20. Frame 14 is substantially rectangular in shape and includes an end 22 having a pair of elongated bosses 24*a*, 24*b* extending towards the interior of the frame. Elongated boss 24*a* has a pair of apertures 26*a*, 26*b* therethrough, and elongated boss 24*b* has a pair of through apertures 27*a*, 27*b*.

Dampers 16*a* and 16*b* both have a generally planer configuration, although, each damper has a longitudinally extending integral axle 28*a*, 28*b*, respectively, that is offset from the major plane of the damper and extends beyond the ends thereof as is well known in the art.

Operating lever 18 extends along a major plane substantially parallel to the plane of the paper in FIGS. 1 and 2 and includes thumb ridges 30, an elongated slit 31 and a flared projection 32 for connecting the operating lever to end 22 of frame 14. Operating lever 18 also includes a pair of fingerlike projections 34*a*, 34*b* extending substantially perpendicular to the major plane and defining a slit 35 located therebetween.

Following lever 20 lies generally along a major plane that is substantially parallel to the major plane of operating lever 18 and includes a tab 37 and pair of fingerlike projections 38*a*, 38*b*, all extending generally perpendicular to the major plane thereof. Fingerlike projections 38*a*, 38*b* define a slit 39 located therebetween. Following lever 20 also has a flared projection 36 for connecting the lever to end 22 of frame 14.

Air register 10 is assembled with flared projection 32 pivotally connecting operating lever 18 to aperture 26*a* and flared projection 36 pivotally connecting following lever 20 to aperture 27*a*. Following lever 20 is connected to operating lever 18 by tab 37 which is received in and follows the movement of elongated slot 31. Damper 16*a* is pivotally connected to frame 14 by integral axle 28*a* which is inserted into aperture 26*b* and a corresponding aperture (not shown) on the opposite end of the frame. Likewise, damper 16*b* is pivotally connected to frame 14 by integral axle 28*b* which is received in aperture 27*b* and a corresponding aperture (not shown) at the opposite end of the frame. The dampers are slidingly connected to the levers as damper 16*a* is received in and slides within slit 35, and damper 16*b* is received in and slides within slit 39.

To operate the dampers, operating lever 18 is pivoted about flared projection 32 by pushing or pulling on thumb ridges 30. While moving from the open position of FIG. 1 to the closed position of FIG. 2, projection 34*a* pulls damper 16*a* into the closed position. Simultaneously, lever 20 is pivoted about flared projection 36 as tab 37 follows the movement of and pivots within slot 31, and projection 38*b* pulls damper 16*b*. Alternately, while moving the dampers to the open position, projection 34*b* pushes on damper 16*a*, and projection 38*a* pushes on damper 16*b* as tab 37 follows slot 31.

While the foregoing prior art discloses numerous mechanisms for operating dampers in an air register, the need continues for an improved register as many of the prior art control mechanisms tend to be stiff or difficult to move when trying to adjust the position of the dampers. On the other hand, some prior art registers have dampers that are easy to move, but have a tendency to shift from the position in which they are set or to vibrate and rattle as air flows through the register or other vibratory energy is imparted on the register.

It has also been known to provide registers with motorized dampers as is found in U.S. Pat. Nos. 4,417,687 to W. Grant and 5,588,911 to R. Gomez, both of which are incorporated herein by reference. Motorized controls, however, may significantly add to the cost of a register and may require maintenance or repair that is not necessary with a manual register.

Therefore, it is an object of the invention to provide a cost efficient register with dampers that move smoothly between the open and closed positions and tend to remain in the position set until intentionally moved therefrom. It is also an object of the invention to provide a register wherein the dampers are resistant to rattling. It is another object of the invention that the resistance to rattling is accomplished by a biasing mechanism.

SUMMARY OF THE INVENTION

The objects of the invention have been accomplished by providing a register to be mounted in a vent opening of a wall, floor, or ceiling for regulating the passage of air. The register includes a grill having a plate with grill openings for directing the passage of air therethrough, a frame connected to the bottom of the grill, at least one damper for regulating air flow through the register, a pivotal connection connecting the damper to the frame to allow pivotal movement therebetween, and a control mechanism for moving the damper between an open position permitting air to flow through the register and a closed position wherein air is inhibited from flowing through the register.

Another feature of the invention is to provide first and second connecting ears extending from a major plane of the damper in directions opposite from one another. In the embodiment shown, the connecting ears extend substantially perpendicular from the major plane.

It is also a feature of the invention that the control mechanism is pivotally connected to at least one of the connecting ears.

Another aspect of the invention is that the first and second connecting ears have apertures therethrough and the control mechanism is pivotally connected to at least one of the apertures. The control mechanism may include a control bar pivotally connected to the damper.

An additional feature of the invention is that the control bar includes a spring member biasing the damper towards the frame. The spring member has a finger that is received in an aperture in one of the connecting ears.

A further aspect of the invention is that the control mechanism has a lever pivotally connected to the frame. The lever has a butterfly aperture with a reduced midsection.

Also, a feature of the invention is that the control bar of the control mechanism has a projection. The projection is received in the butterfly aperture, and the butterfly aperture limits movement of the control bar as the damper is moved between the open and closed positions.

Another feature of the invention is that the lever includes a boss to space the lever from the frame.

It is also an aspect of the invention that the frame has a boss that is adjacent to the boss of the lever at a location where the lever is pivotally connected to the frame.

An additional feature of the invention is that the lever has a bearing tab projecting towards the frame to assist in maintaining alignment of the lever while it is pivoted.

Another aspect of the invention is that the damper has an integrally formed axle. The axle has a limiting extension to limit movement of the damper in a direction along the axle so as to maintain the pivotal connection.

In one embodiment of the invention, the register has two dampers which rotate in opposite directions from one another. The control mechanism is connected to the first connecting ear on one of the dampers and to the second connecting ear on the other damper.

It is also a feature of the invention that the control mechanism is connected to the connecting ears in a fashion that moves the dampers in a push-pull manner wherein as the dampers are pivoted, the control mechanism pushes on one of the dampers while simultaneously pulling on the other damper.

A further aspect of the invention is that the control mechanism pushes on the one damper and pulls on the other damper as the dampers are being pivoted to the closed position, and alternately, pushes on the other damper and pulls on the one damper as the dampers are being pivoted to the open position.

In the embodiment of the invention depicted, the dampers are identical.

Other features of the invention will become apparent to one skilled in the art upon reading the claims and the following detailed description of the invention and upon viewing the attached figures.

DESCRIPTION OF THE PREFERRED EMBODIMENT

Figure 1:
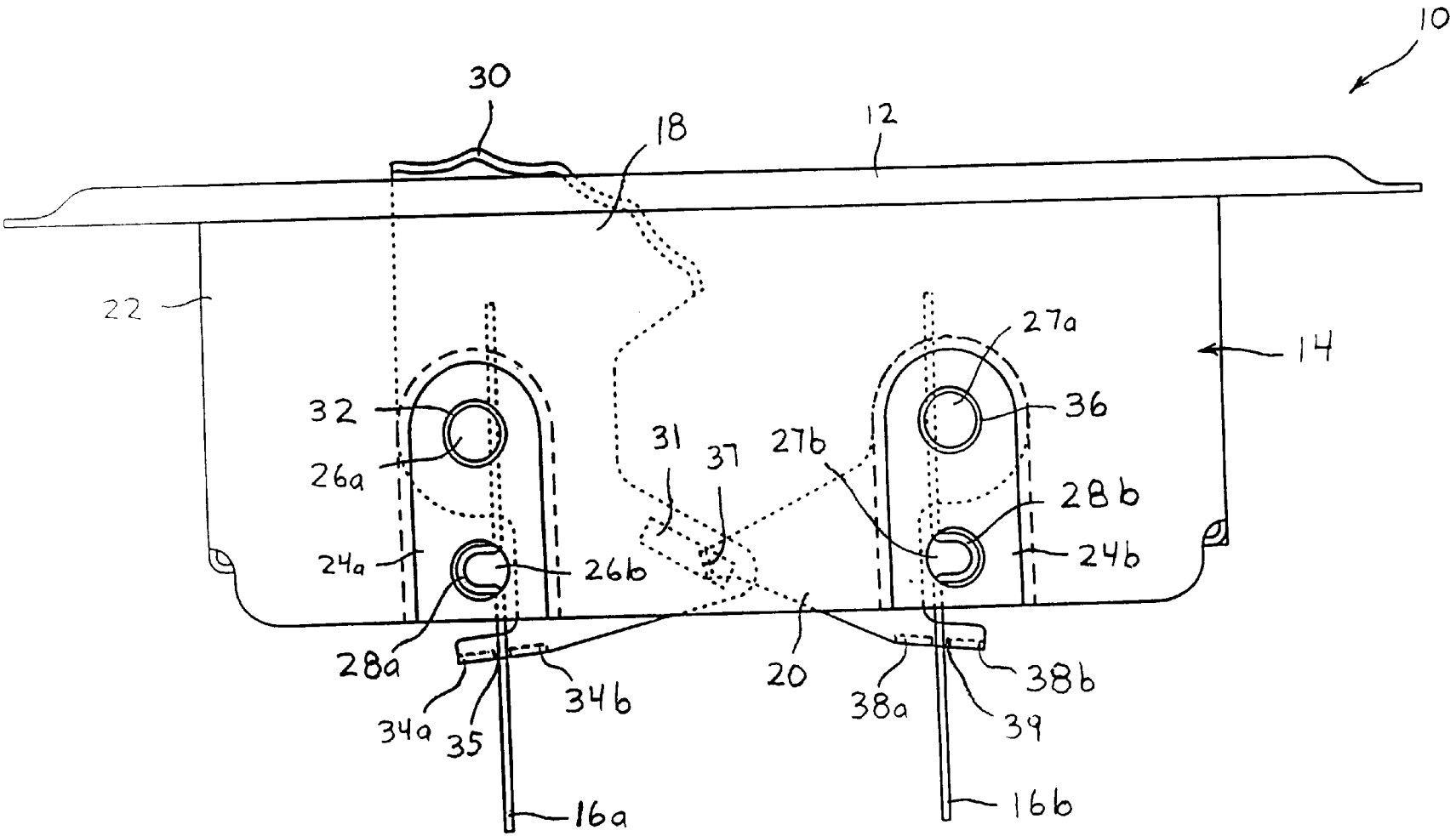
FIG. 1 (Prior Art)
FIG. 1 is an end view of a prior art register showing the dampers in the open position.
Figure 2:
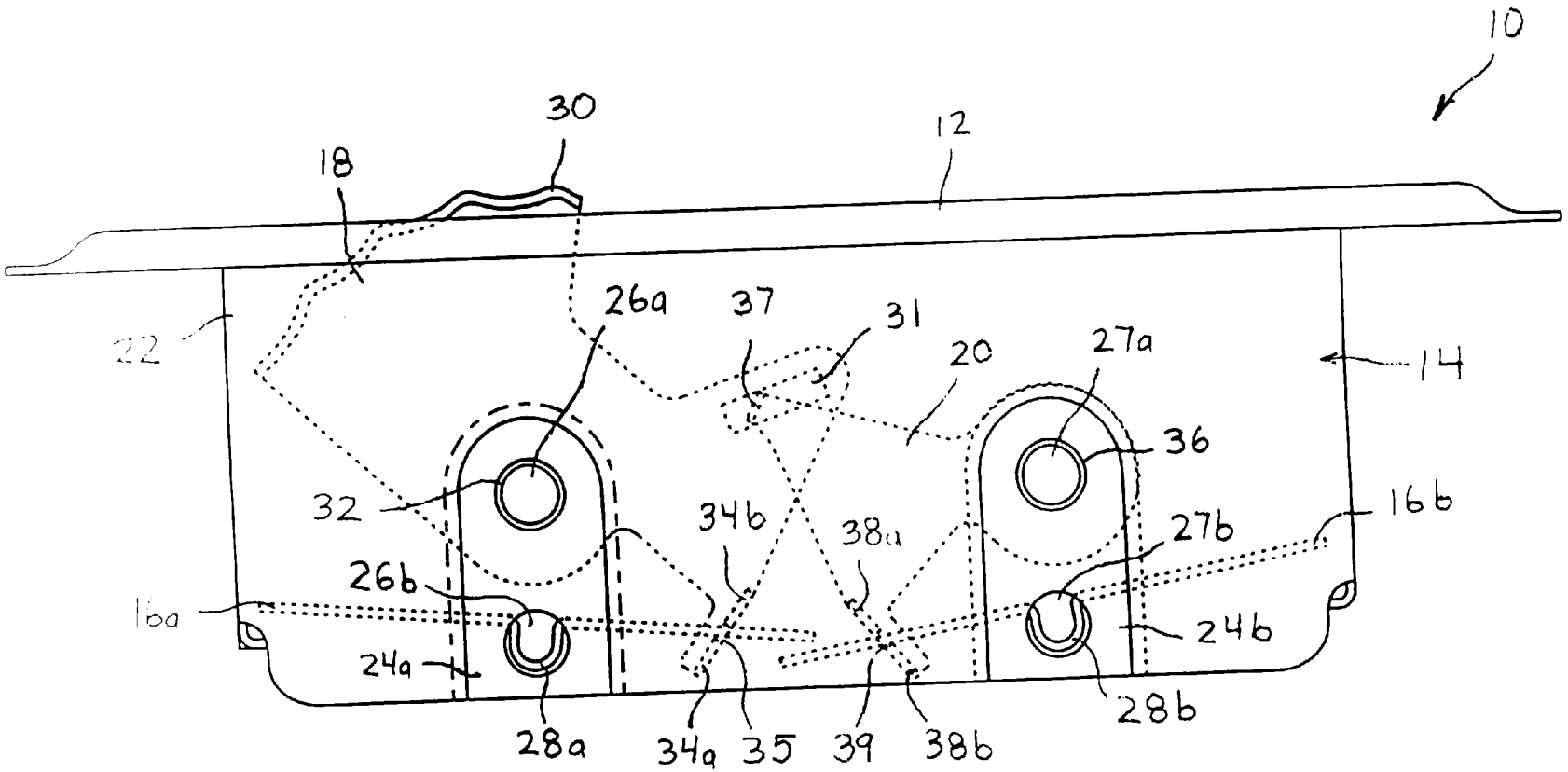
FIG. 2 (Prior Art)
FIG. 2 is an end view of the prior art register of FIG. 1 showing the dampers being moved into a closed position.
Figure 3:
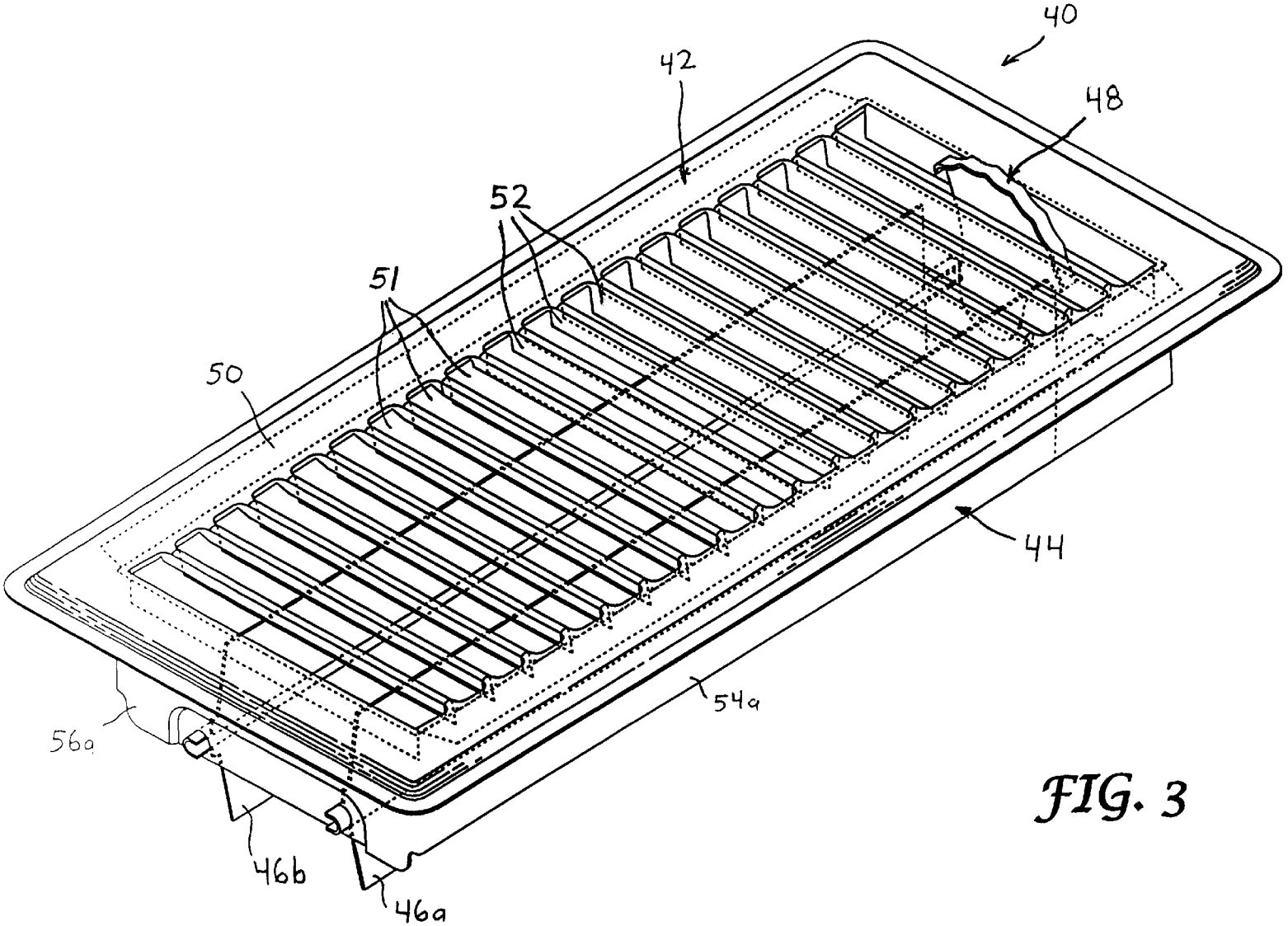
FIG. 3 is a perspective view of the air register of the present invention wherein the dampers are in an open position.
Figure 4:
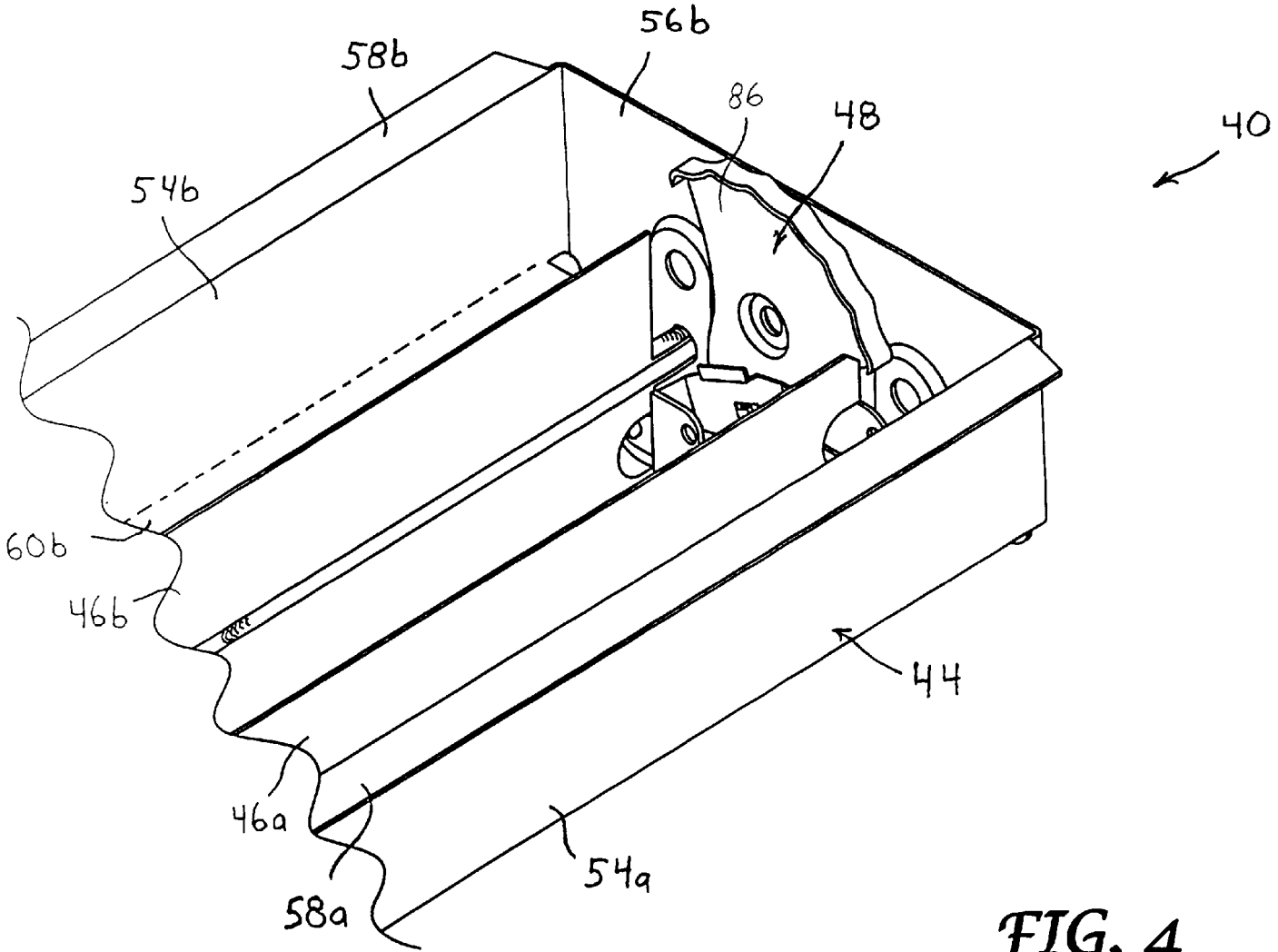
FIG. 4 is a partial perspective view of the air register with the grill removed showing the control mechanism of the present invention.
Figure 5:
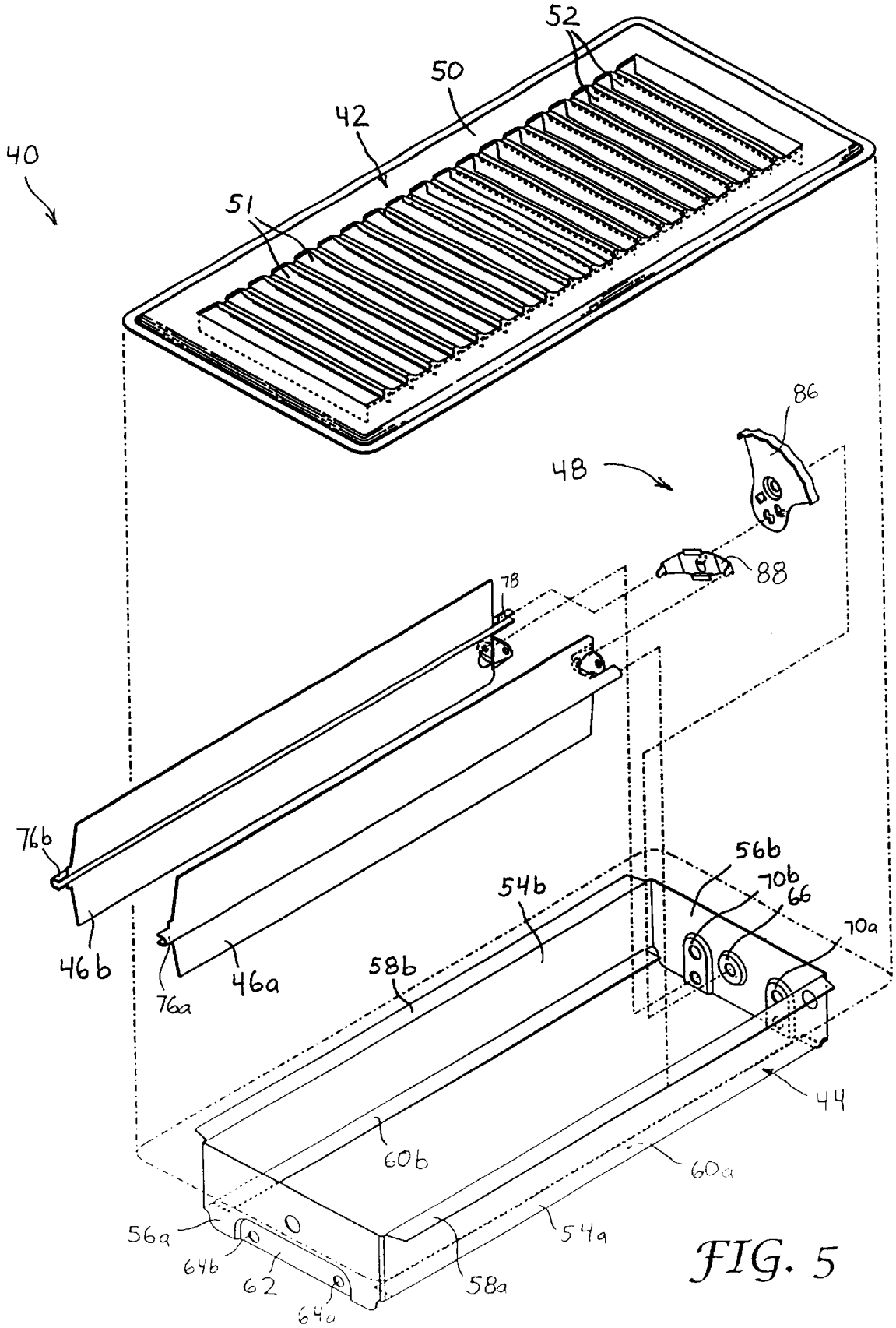
FIG. 5 is an exploded perspective view of the air register.

Referring to FIGS. 3–5, an air register of the present invention for mounting in a vent opening in a wall, floor or ceiling for regulating the passage of air from an air duct (not shown) is generally indicated as 40. Air register 40 includes a grill or face plate generally indicated as 42, a frame or body generally indicated as 44, dampers or louvers 46*a*, 46*b* and a control mechanism generally indicated as 48 for moving the dampers between an open position allowing air to flow through the register and out the grill and a closed position wherein air is inhibited from flowing through the register.

As best seen in FIG. 3, grill 42 includes a generally planer surface 50 having grill openings 51 therethrough to allow air to pass from a duct (not shown) through register 40 into a room (not shown). Between grill openings 51 are fins or vanes 52 to direct air flow through the grill.

Frame 44 has a generally rectangular shape, as is best seen in FIG. 5, and includes two generally parallel side portions 54*a*, 54*b* and two generally parallel end portions 56*a*, 56*b*, which are orthogonal to the side portions. Each of the side portions 54*a*, 54*b* has an outwardly extending flange 58*a*, 58*b*, respectively, at the top thereof, and an inwardly extending flange 60*a*, 60*b*, respectively, at the lower end. End portion 56*a* of frame 44 includes a horizontally extending boss 62 having a pair of damper mounting apertures 64*a*, 64*b*. End portion 56*b* includes a centrally located boss 66 having an aperture 68 therethrough, and a pair of elongated inwardly extending bosses 70*a*, 70*b* each having a pair of apertures 72*a*, 72*b* and 74*a*, 74*b*, respectively, as best shown in FIG. 6.

Figure 7:
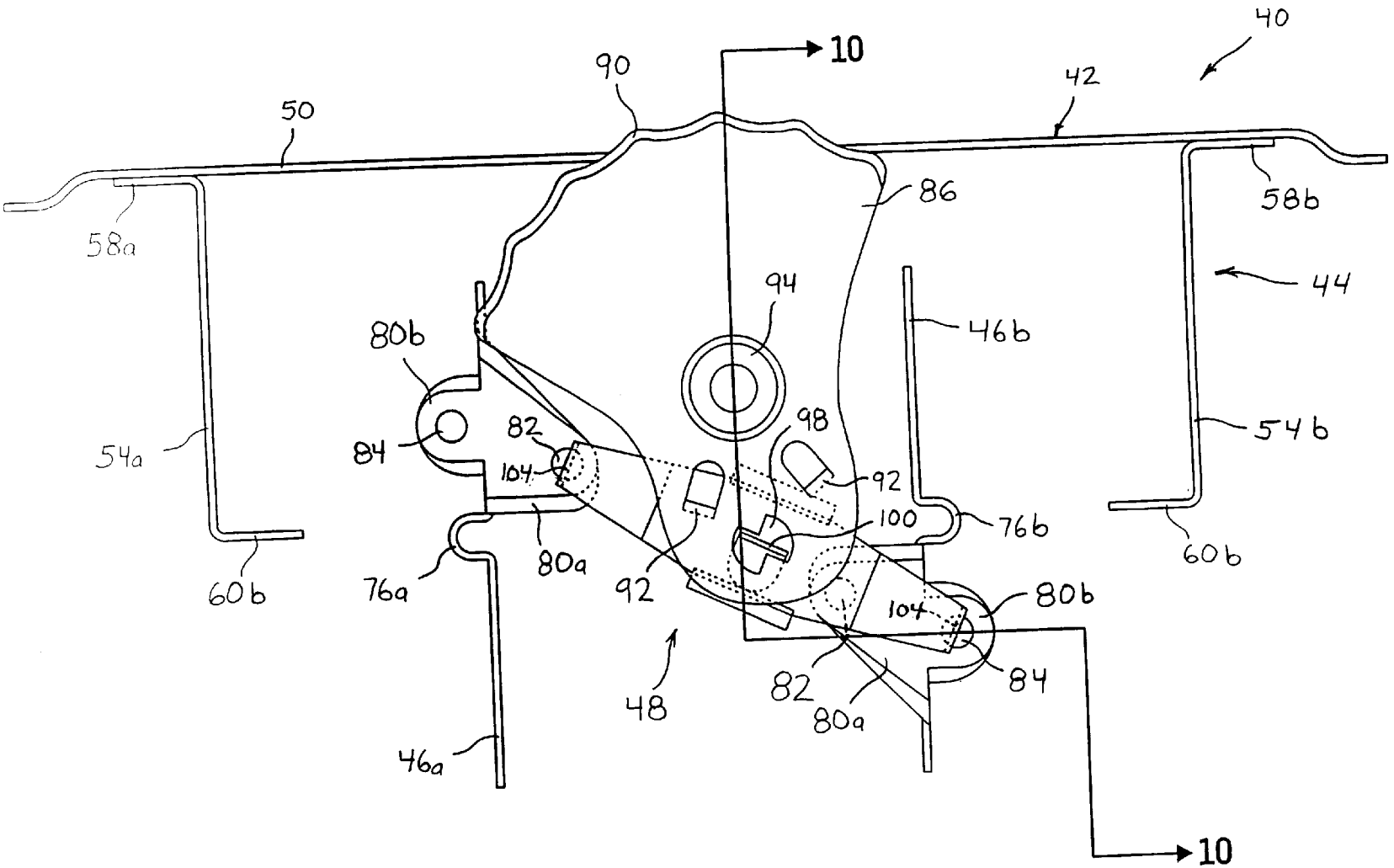
FIG. 7 is an end view of the air register with the ends of the frame removed showing the dampers in the open position.
Figure 8:
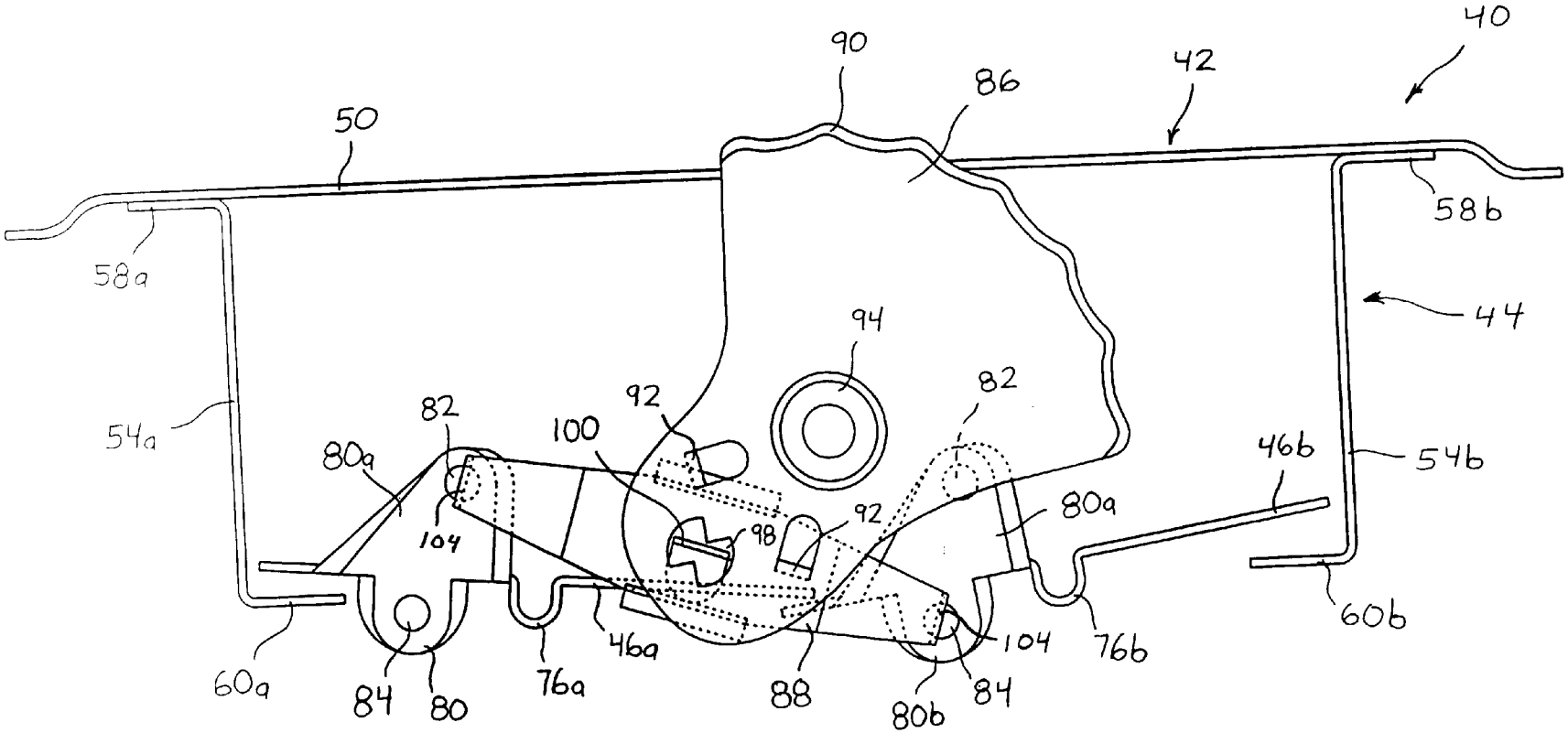
FIG. 8 is an end view of the air register with the ends of the frame removed showing the dampers in the closed position.
Figure 9:
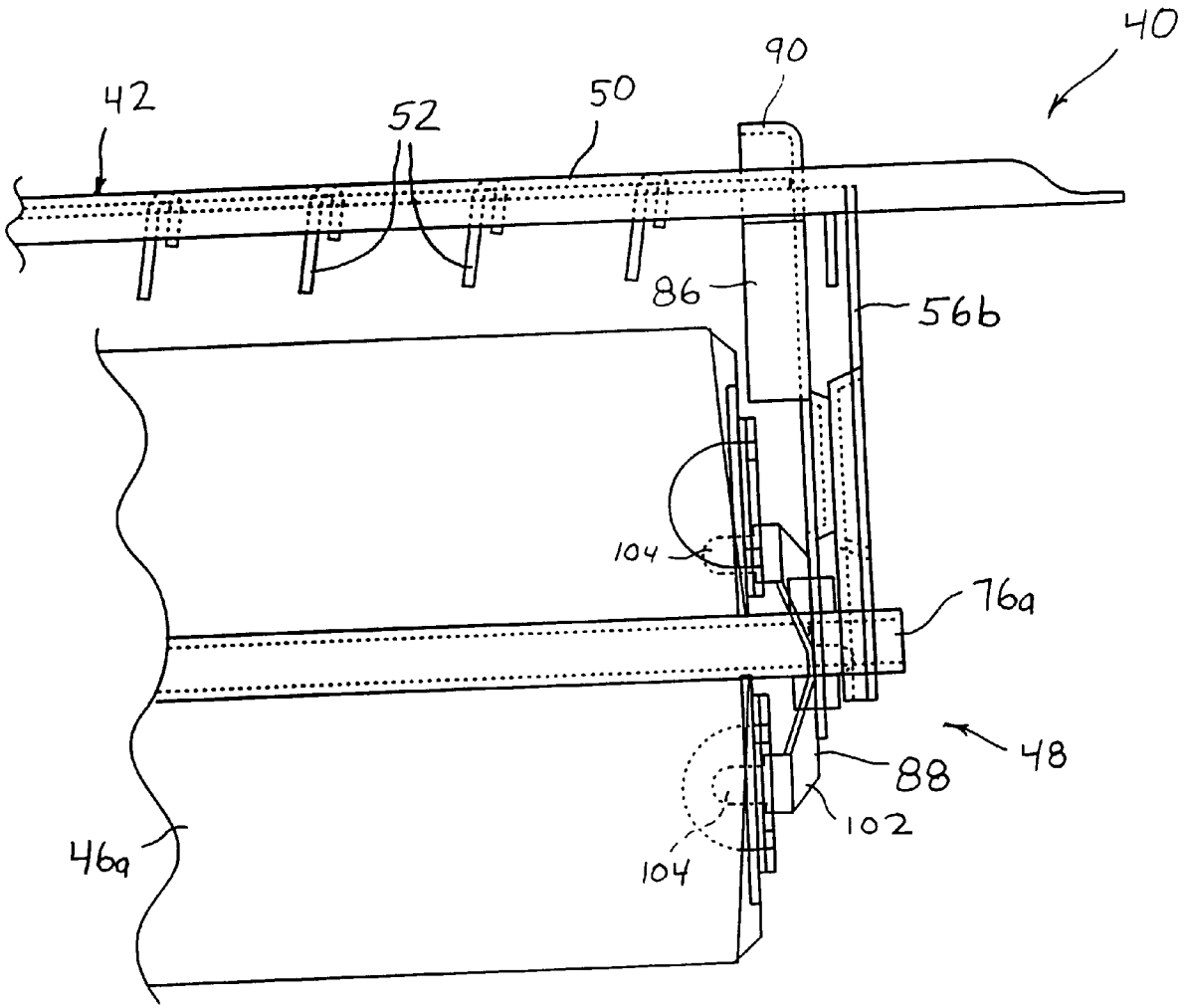
FIG. 9 is a side view of the control mechanism with the side of the frame removed.

Dampers 46*a*, 46*b* have a generally planer blade-like configuration and each includes an integrally formed axle 76*a*, 76*b*, respectively, that is offset from the major plane of each damper. Each of said axles includes an extension member 78 for limiting lateral movement of the damper when installed in frame 44. Each damper also includes a pair of connecting ears 80*a*, 80*b* with each connecting ear having an aperture,82, 84, respectively, therethrough (FIGS. 7 and 8).

Figure 6:
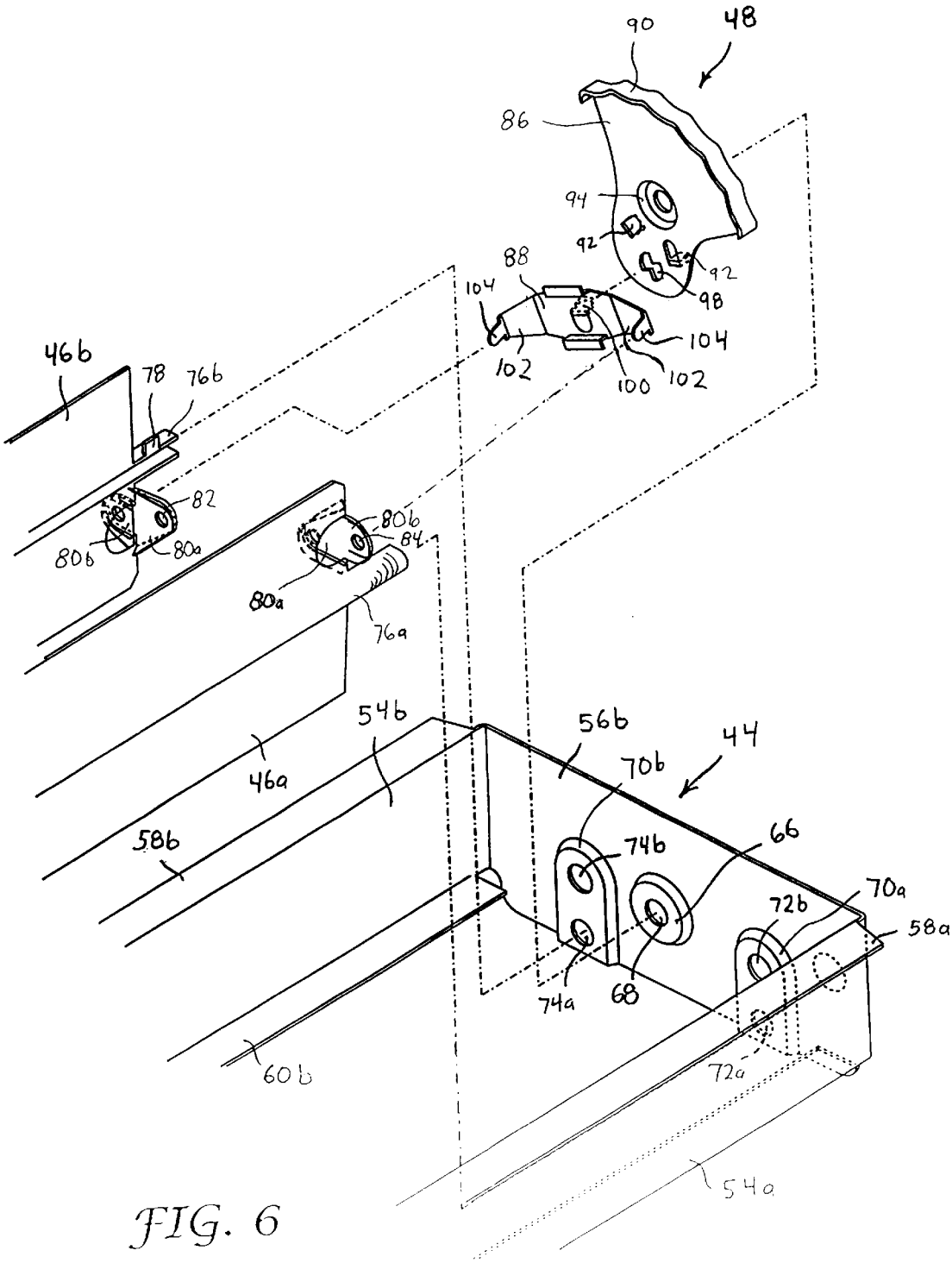
FIG. 6 is an exploded perspective view of the control mechanism.
Figure 10:
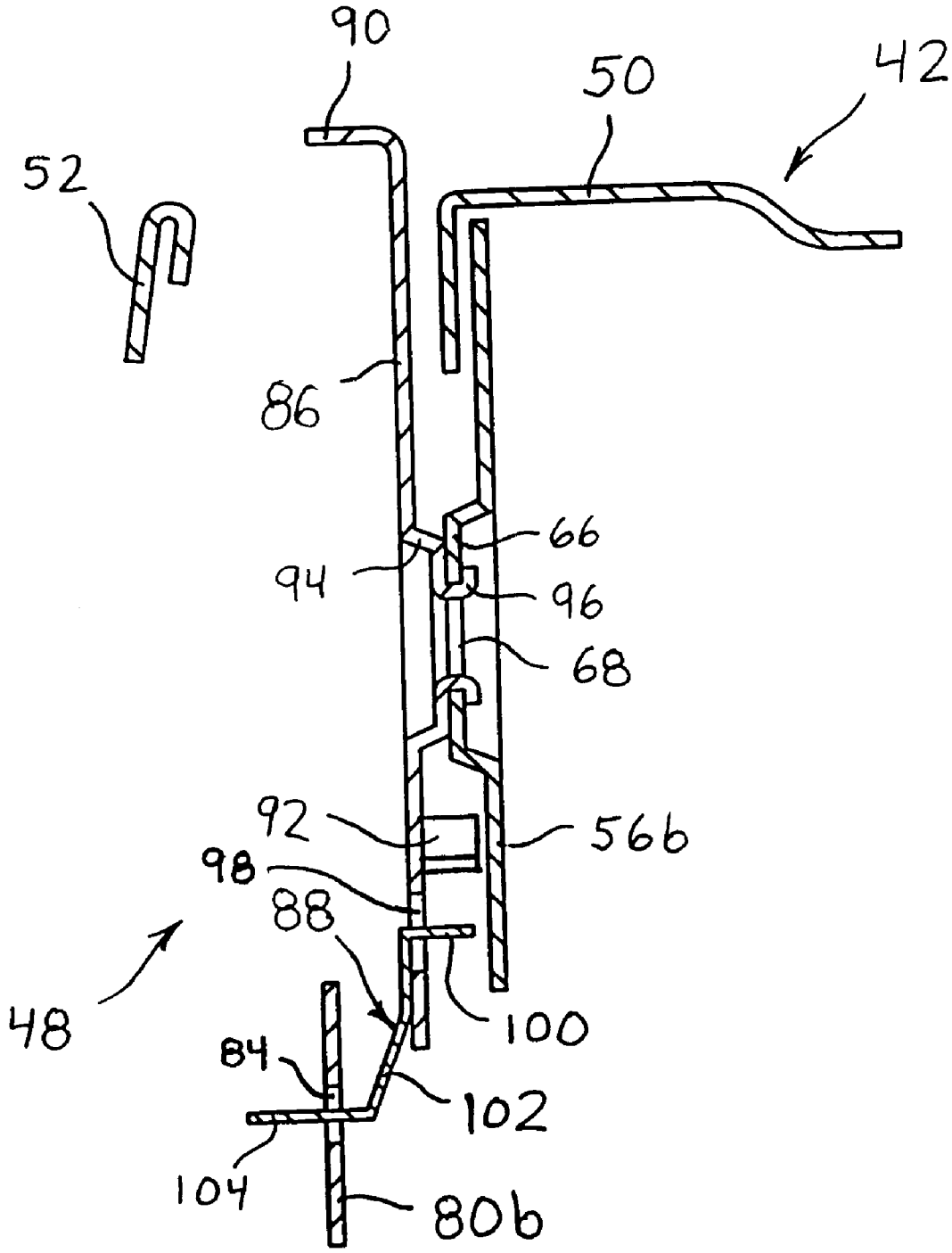
FIG. 10 is a cross-sectional view of the control mechanism taken along line 10—10 in FIG. 7.

As shown in FIGS. 6 and 10, control mechanism 48 includes a lever 86 and a control bar 88. Lever 86 has thumb ridges 90 for use in rotating the lever, bearing tabs 92 and a boss 94 having a centrally flared portion 96. Lever 86 also includes a butterfly aperture 98 having a reduced midsection. Butterfly aperture 98 is more fully explained in U.S. patent application 10/010,174 (Attorney's Reference CON004) incorporated herein by reference.

Control bar 88 of control mechanism 48 includes a projection 100 and a pair of integrally formed leaf springs 102. Each leaf spring includes a finger or projection 104.

Having outlined the component parts of air register 40, the manufacturing and assembly thereof will be discussed in further detail. In the preferred embodiment, grill 42 is stamped and formed from a single piece of sheet metal as is well known in the art. Frame 14 is also stamped and formed from sheet metal wherein three of the comers between side portions 54*a*, 54*b* and end portions 56*a*, 56*b* consist of bends in the sheet. Ends of the frame are joined together with a crimped connection to form the remaining comer.

Dampers 46*a*, 46*b* are also stamped and formed from sheet metal including connecting ears 80*a*, 80*b* which are stamped and bent at an angle approximately perpendicular to the major plane of each damper. The dampers are mounted to frame 44 by inserting integral axle portions 76*a*, 76*b* in apertures 64*a*, 72*a* and 64*b*, 74*a*, respectively. While the dampers are being inserted into the frame, the extensions 78 are bent so that the portion of axles 76*a*, 76*b* where the extension is attached, will pass through apertures 72*a*, 74*a*, respectively. After the damper is in place, extensions 78 are bent outwardly as shown in FIG. 6 so that they will not pass through apertures 72*a*, 74*a* to pivotally retain the dampers therein.

In the preferred embodiment, lever 86 is likewise stamped and formed from sheet metal. Control bar 88 is formed from a thin springy material designed to provide the stiffness and resiliency required for leaf springs 102.

Control mechanism 48 is assembled with lever 86 positioned so that thumb ridges 90 will protrude through one of the grill openings 51 passed the top surface 50 of grill 42. Boss 94 of lever 86 is positioned adjacent to centrally located boss 66 of end portion 56*b* with flared portion 96 extending through the aperture 68 in boss 66 forming a pivotal connection therewith as is best shown in FIG. 10. Bearing tabs 92 extend substantially perpendicular from lever 86 towards end portion 56*b* of frame 44. Control bar 88 is connected to lever 86 with projection 100 which is received in butterfly aperture 98, so that control bar 88 follows lever 86. Projection 100 can partially pivot within the butterfly aperture 98, but the pivotal movement is limited by the reduced midsection of the aperture. The control bar is connected to dampers 46*a*, 46*b* by inserting fingers 104 into either aperture 82 of connecting ear 80*a* or aperture 84 of connecting ear 80*b*. In the preferred embodiment, one of the fingers 104 is connected to aperture 82 of connecting ear 80*a* on damper 46*a*, and the other finger 104 is connected to aperture 84 of connecting ear 80*b* on damper 46*b*.

To complete the register, frame 44 is attached to grill 42 by spot welding the upper outwardly extending flanges 58*a*, 58*b* to the side of the grill opposite planer surface 50. Of course, other attachment means which are well known in the art such as seam welding, arc welding, studs, rivets, or bolts may be used to attach the frame to the grill. Air register 40 can then be placed in the duct for the regulation of air therethrough. If the duct is located in a floor, air register 40 may be simply placed in the duct wherein grill 42 will rest upon and be supported by the floor or duct. For a wall or ceiling duct, holes may be drilled in grill 42 so that it may be attached to the duct using screws or other fastenings means well known in the art.

As discussed above, air register 40 is designed such that dampers 46*a*, 46*b* may be moved between an open position allowing air to flow through the duct and out grill openings 51 of grill 42 into the room and a closed position wherein air is inhibited from moving through the register. In the open position, dampers 46*a*, 46*b* lie in generally parallel planes being substantially perpendicular to planer surface 50 of grill 42 as is shown in FIG. 7. In the closed position, dampers 46*a*, 46*b* lie substantially in a common plane being parallel to planer surface 50. In FIG. 8, the dampers are almost closed and when fully closed, damper 46*a* will be adjacent lower inward flange 60*a* and damper 46*b* will be adjacent lower inward flange 60*b*. Also in the closed position, the edges of dampers 46*a*, 46*b* opposite the inwardly extending flanges 60*a*, 60*b* will overlie one another as shown in FIG. 8.

Moving the dampers between the open and closed position is accomplished by means of control mechanism 48. To change the positioning of the dampers, a user rotates lever 86 using the thumb ridges 90 protruding above surface 50 of the grill. As projection 100 of control bar 88 is received within butterfly aperture 98 of lever 86, the control bar generally follows the movement of the lever. As the lever is being moved, projection 100 partially pivots within butterfly aperture 98 as limited by the reduced midsection of the aperture as is best shown in FIG. 7. As lever 86 is pivoted about flared portion 96, bearing tabs 92 help maintain the proper alignment of the lever by precluding the bottom portion of the lever from being skewed towards end portion 56*b* of frame 44 as is evident from FIG. 10.

Pivotal movement of the control bar relative to the lever results from fingers 104 being pivotally connected to apertures 82 and 84 on the respective connecting ears. This unique linkage produces a push-pull movement of the dampers. The push-pull movement is evident from FIGS. 7 and 8 wherein it can be seen as the dampers would be moved from the open position in FIG. 7 to the substantially closed position in FIG. 8, one finger 104 pushes on connecting ear 80*a* of damper 46*a*, while the other finger 104 pulls on connecting ear 80*b* of damper 46*b*. Alternately, as the dampers would be moved from the closed position of FIG. 8 to the open position of FIG. 7, the one finger 104 pulls on connecting ear 80*a* of damper 46*a* and pushes on connecting ear 80*b* of damper 46*b*. Of course, as the dampers rotate between the open and closed positions, integral axles 76*a*, 76*b* rotate within their respective apertures in end portions 56*a*, 56*b*.

It should be appreciated, that leaf springs 102, which are attached to and integral with control bar 88, provide a constant force against the connecting ears to which the associated fingers are connected. This biasing force helps to inhibit vibration and rattling of the dampers as the dampers are pushed against the opposite end portion 56*a* of frame 44 which eliminates play in the pivot connections between integral axles 76*a*, 76*b* and their receiving apertures. An additional feature of the invention is that the dampers are each biased individually by a separate leaf spring, which is believe to be more effective than biasing the dampers as a group.

It should also be appreciated that the dampers may be moved to a position intermediate to the open and closed position to somewhat restrict airflow through the register and/or to provide directional control of the airflow. The urging force provided by the leaf springs helps maintain the dampers in the intermediate position without rattling and without the dampers falling to the open position, yet the unique design still enables free and easy movement of the lever for positional changes of the dampers.

The invention has been taught with specific reference to the embodiment and the drawings herein, although, someone skilled in the art will recognize that changes can be made in form and detail without departing from the spirit and scope of the invention. For example, although vanes 52 in grill 42 have been depicted as the fixed type, moveable vanes or fins which are known in the art may also be incorporated for enhanced control of the direction of airflow. Also, other materials and/or manufacturing processes may be utilized for manufacturing the air register. For instance, vacuum or injection mold plastics or castings may be suitable. Moreover, the air register depicted utilizes two dampers, the invention may be used on a register with more or less dampers. In addition, although the dampers in the preferred embodiment utilize cost efficient integrally formed axles, the dampers may also be made with separate axles connected to the dampers and rotationally mounted in the damper receiving apertures. Furthermore, the apertures may be replaced by pins mounted to the frame and inserted into the axle portions, or the dampers may be otherwise pivotally connected to the frame. It is also possible to utilize other types of spring members, such as coil springs, instead of the leaf springs used in the preferred embodiment.

Also, the embodiments depicted in the present invention are directed primarily to a manually operated damper control mechanism; however, it should be appreciated that the features herein may also be useable with a motorized damper control as taught by the prior art patents or otherwise known in the art. The scope of the invention is therefore, indicated by the attached claims rather than by the description.

What is claimed is:

1. A register to be mounted in a vent opening of a wall, floor, or ceiling for regulating the passage of air, comprising a grill including a plate having grill openings for directing the passage of air therethrough; a frame connected to the bottom of the grill; at least one damper for regulating air flow through the register, said damper having first and second connecting ears extending from a major plane of said damper in directions opposite from one another; a pivotal connection connecting said damper to said frame to allow pivotal movement therebetween; and a control mechanism for moving said damper between an open position permitting air to flow through said register and a closed position where air is inhibited from flowing through said register.

2. The register as set forth in claim 1 wherein said connecting ears extend substantially perpendicular to the major plane.

3. The register as set forth in claim 1 wherein the control mechanism is pivotally connected to at least one of said connecting ears.

4. The register as set forth in claim 1 wherein there are two dampers which rotate in directions opposite from one another.

5. The register as set forth in claim 4 wherein said control mechanism is connected to said first connecting ear on one of said dampers and to said second connecting ear on said other damper.

6. The register as set forth in claim 5 wherein said first and second connecting ears have apertures therethrough and said control mechanism is pivotally connected to said apertures.

7. The register as set forth in claim 1 wherein said control mechanism includes a control bar pivotally connected to said damper.

8. The register as set forth in claim 7 wherein said control bar includes a spring member biasing said damper towards said frame.

9. The register as set forth in claim 8 wherein said spring member includes a finger, said finger received in an aperture in one of said connecting ears.

10. The register as set forth in claim 1 wherein said control mechanism includes a lever pivotally connected to said frame, said lever having a butterfly aperture with a reduced midsection.

11. The register as set forth in Claim 10 wherein said control mechanism includes a control bar having a projection, said projection is received in said butterfly aperture, and said butterfly aperture limits pivotal movement of said control bar as said damper is moved between the open and closed positions.

12. The register as set forth in claim 10 wherein said lever includes a boss to space said lever from said frame.

13. The register as set forth in claim 12 wherein said frame also includes a boss juxtaposed, said boss of said lever at a location where said lever is pivotally connected to said frame.

14. The register as set forth in claim 12 wherein said lever has a bearing tab projecting towards said frame to assist in maintaining alignment of said lever when pivoted.

15. The register as set forth in claim 1 wherein said damper has an integrally formed axle, said axle having a limiting extension to limit movement of said damper in a direction along said axle so as to maintain said pivotal connection.

16. A register to be mounted in a vent opening of a wall, floor, or ceiling for regulating the passage of air, comprising a grill including a plate having grill openings for directing passage of air therethrough; a frame connected to the grill; first and second dampers for regulating air flow through the register, said dampers each having at least one connecting ear; a pivotal connection connecting said dampers to said frame to allow pivotal movement therebetween; and a control mechanism for moving said dampers between an open position permitting air to flow through said register and a closed position wherein air is inhibited from flowing through said register, said control mechanism connected to said connecting ears and moving said dampers in a push-pull manner wherein as said dampers are pivoted, the control mechanism pushes on said first damper while simultaneously pulling on said second damper.

17. The register as set forth in claim 16 wherein said control mechanism pushes on said first damper and pulls on said second damper as said dampers are being pivoted to the closed position, and alternately, pushes on said second damper and pulls on said first damper as said dampers are being pivoted to the open position.

18. The register as set forth in claim 16 wherein each damper has first and second connecting ears.

19. The register as set forth in claim 18 wherein said dampers are identical.

20. The register as set forth in claim 19 wherein said first and second connecting ears on each damper extend from a major plane of said damper in directions opposite from one another.

21. The register as set forth in claim 20 wherein said first and second connecting ears on each damper extend substantially perpendicular to the major plane.

22. The register as set forth in claim 18 wherein said first and second connecting ears each have apertures therethrough.

23. The register as set forth in claim 22 wherein said control mechanism includes a control bar, said control bar being pivotally connected to one of said apertures on each of said dampers.

24. The register as set forth in claim 23 wherein said control bar includes spring members biasing said dampers towards said frame.

25. The register as set forth in claim 24 wherein said spring member s have fingers pivotally connecting s aid control bar to said apertures in said connecting ears.

26. The register as set forth in claim 16 wherein said control mechanism includes a lever pivotally connected to said frame, said lever having a butterfly aperture with a reduced midsection, and a control bar having a projection, said projection being received in said butterfly aperture, said butterfly aperture limiting pivotal movement of said control bar as said dampers are moved between the open and closed positions.

27. The register as set forth in claim 26 wherein said lever includes a boss to space said lever from said frame and a bearing tab projecting towards said frame to assist in maintaining alignment of said lever when pivoted.

28. The register as set forth in claim 16 wherein said dampers have integrally formed axles, said axles having a limiting extension to limit movement of said damper in a direction along said axle so as to maintain said pivotal connection.

29. The register as s et forth in claim 23, wherein said control bar is connected between said first connecting ear of one of said dampers , with said second ear of said other damper.

30. The register of claim 29, wherein when in the open position, s aid first and second interconnected connecting ears are on opposite sides of a center of rotation of said dampers.

31. A register to be mounted in a vent opening of a wall, floor, or ceiling for regulating the passage of air, comprising a grill with openings, a frame connected to the grill, at least one damper for regulating air flow through the register, and a control mechanism for moving said damper between an open position permitting air to flow through said register and a closed position wherein air is inhibited from flowing through said register, said control mechanism including a lever pivotally connected to said frame, said lever including a boss to space said lever from said frame and a bearing tab projecting towards said frame to assist in maintaining alignment of said lever when pivoted.

32. The register as set forth in claim 31 wherein said control mechanism further includes a control bar having spring members biasing said damper towards said frame.

33. The register as set forth in claim 31 wherein said damper includes a pair of connecting ears extending in opposite directions from a major plane of said damper.

34. The register as set forth in claim 33 wherein said connecting ears have apertures therethrough, and said control mechanism is pivotally connected to one of said apertures.

* * * * *

UNITED STATES PATENT AND TRADEMARK OFFICE

CERTIFICATE OF CORRECTION

PATENT NO. : 6,503,140 B1 
DATED : January 7, 2003
INVENTOR(S) : Gerald D. Haynes It is certified that error appears in the above-identified patent and that said Letters Patent is hereby corrected as shown below:

Column 9,
Line 5, “member s” should be -- members --; and “s aid” should be -- said --
Line 26, “dampers ,” should be -- dampers, --

Column 10,
Line 2, “s aid” should be -- said --

Signed and Sealed this

Twenty-fifth Day of March, 2003

JAMES E. ROGAN
*Director of the United States Patent and Trademark Office*